United States Patent [19]

Dearborn et al.

[11] Patent Number: 4,738,383

[45] Date of Patent: Apr. 19, 1988

[54] PORTABLE TAKE APART PACK FRAME

[76] Inventors: James C. Dearborn; Ronald R. King, both of 4496 Industrial St., Simi Valley, Calif. 93063

[21] Appl. No.: 910,678

[22] Filed: Sep. 23, 1986

[51] Int. Cl.[4] ..... A45F 4/06

[52] U.S. Cl. ..... 224/155; 224/153; 224/156

[58] Field of Search ..... 224/153, 151, 155, 156; 297/1

[56] References Cited

U.S. PATENT DOCUMENTS

| | | | |
|---|---|---|---|
| 3,620,428 | 11/1971 | Silverthorne | 224/156 |
| 3,730,407 | 5/1973 | Russell | 224/156 |
| 3,846,855 | 11/1974 | Peterson | 224/156 X |
| 3,912,138 | 10/1975 | Pava | 224/156 X |
| 4,056,857 | 11/1977 | Quantz | 224/156 X |
| 4,433,802 | 2/1984 | Woolf | 224/153 |
| 4,450,990 | 5/1984 | Bolstad | 224/155 |
| 4,538,750 | 9/1985 | Hanna | 224/156 |

FOREIGN PATENT DOCUMENTS

| | | | |
|---|---|---|---|
| 231623 | 3/1944 | Switzerland | 224/156 |

*Primary Examiner*—Henry J. Recla
*Assistant Examiner*—Robert M. Petrik

[57] ABSTRACT

A pack frame made of metal tubing that readily interfits together for easy assembly or disassembly, shoulder straps for support from a person's shoulders and a storage bag attachable to a lower end of the frame.

4 Claims, 1 Drawing Sheet

PORTABLE TAKE APART PACK FRAME

BACKGROUND OF THE INVENTION

1. Field of the Invention

This invention relates generally to sport hunters' equipment. More specifically, it relates to backpacks or pack boards on which hunters can conveniently carry harvested game back to their camp or vehicle.

2. Description of Prior Art

It is well known to all persons such as hunters, hikers and others who are experienced in backpacking of heavy loads, that a rigid backpack frame is conventionally used with a canvas stretched across it for resting comfortably against a wearer's back. Such backpack frame carries the weight high up so a person can walk erect without need to lean forward, and thus does not tire even after long distances because the weight is on the shoulders and not on the back. However, when not in use carrying a load, its size hinders a person's free walking movement.

SUMMARY OF THE INVENTION

Accordingly, it is a principal object of the present invention, to provide a portable pack frame that can be readily taken apart when not needed to transport a load, so that it may be stowed in a small storage bag commonly termed by hunters as a "fanny pack" for easy carrying.

Other objects are to provide a portable take apart pack frame which is simple in design, inexpensive to manufacture, rugged in construction, quick and easy to assemble or disassemble and efficient in operative use.

These and other objects will be readily evident upon a study of the following Specification and the accompanying Drawing.

DETAILED DESCRIPTION

Figures 1, 2, 3, 4, 5, 6, 7:
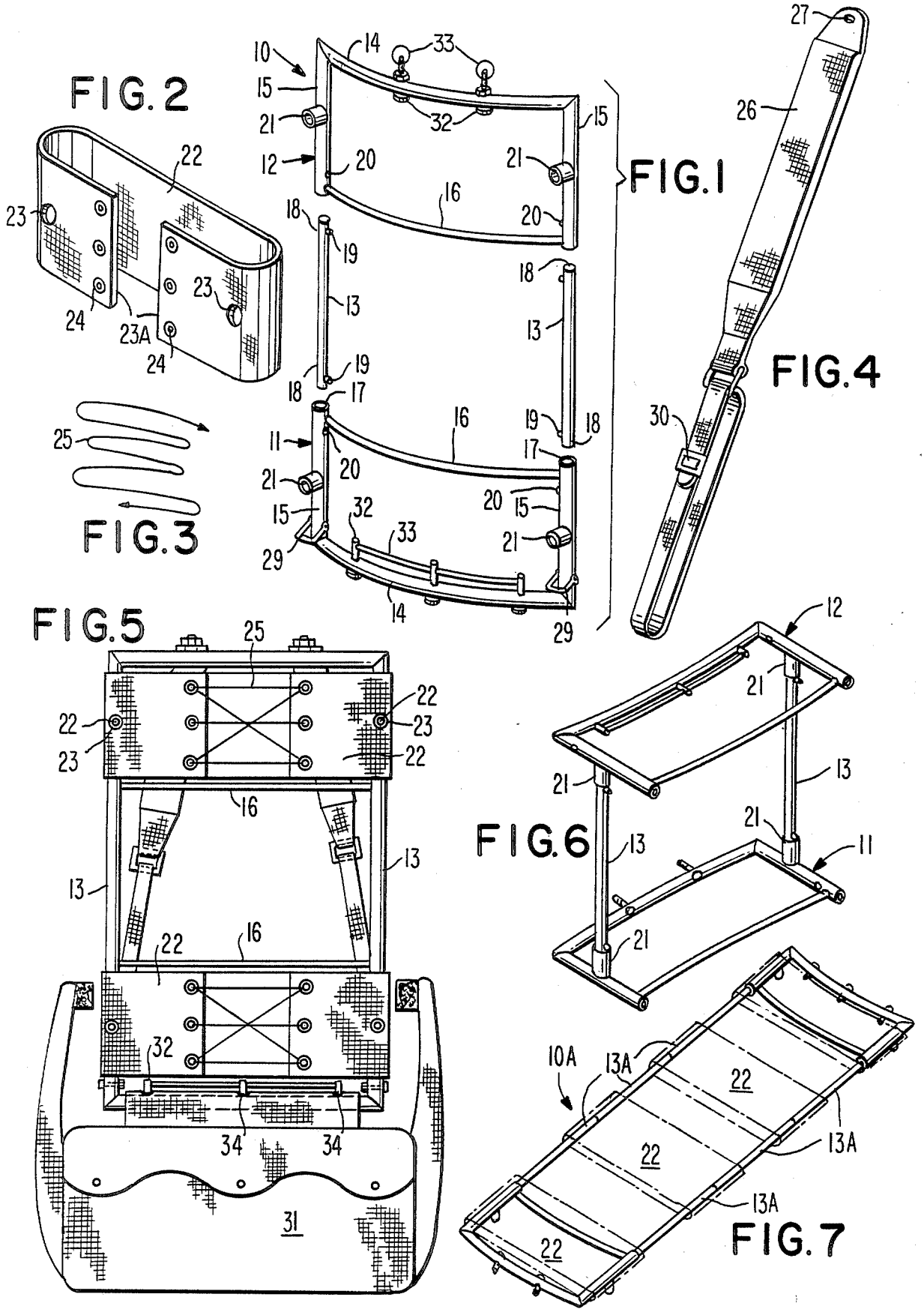
FIG. 1 is a perspective view of the frame of a portable take apart pack, shown exploded.
FIG. 2 is a perspective view of a typical webbing used with the pack.
FIG. 3 is a typical cord used to lace the webbing closed.
FIG. 4 is a perspective view of a typical strap used with the pack.
FIG. 5 is a rear elevational view of the pack, assembled with a storage bag, shown attached to the frame.
FIG. 6 is a perspective view of the frame used as a seat.
FIG. 7 is a perspective view of another embodiment of the invention, in which extra tubing and webbing converts to a wilderness stretcher for large game or injured hiker.

Referring now to the drawing in greater detail, and more particularly to FIGS. 1 to 6 thereof, at this time, the reference numeral 10 represents a portable take apart pack frame, incorporating the present invention, and which includes a lower sub-assembly frame unit 11, an upper sub-assembly frame unit 12 and a pair of extension bars 13 therebetween. The parts are made preferably of strong, light weight, tubular metal. Each unit 11 and 12 comprises an arcuate end tube 14 and a pair of side tubes 15 welded together at their ends into a general "U"-shape, and an arcuate cross-brace 16 between the free ends of the side tubes. The free end of the side tubes have openings 17 for receiving ends 18 of the bars 13 when assembling the pack frame 10. The arcuate members 14 and 16 bow outwardly toward a direction which forms a rear side of the pack frame. A detent 19 on the side tube snap fits in an opening 20 on the end tube for locking the pack frame in assembled position.

A rearwardly projecting, short stub tube 21 welded on each side tube serves to secure a canvas web 22 around the frame by being received in an opening 23 provided for it on the web. The webs serve to rest against a person's back comfortably. Ends **23*a* of the webs are attached together by lacings 25 through lace holes 24** on the web.

A pair of shoulder straps 26 are attached to the pack frame by means of a hole 27 on an upper end of the strap being secured by clevis pins 32 and holding wires 33 on the upper tube 14, and a lower end of the strap being fitted through a ring 29 pivotally attached to the lower unit. The strap includes a buckle 30 so to be adjustable in length.

When the pack frame is in use carrying a load, then a storage or "fanny" bag 31 is attached to the lower unit by means of clevis pins 32 and a holding wire 33. A strip of material on the bag has grommetted holes to receive the pins for securement thereto. The bag serves to support a lower end of a load carried on the pack frame.

As shown in FIG. 6, the pack frame may be assembled to form a chair 35 by fitting tubes 13 into stub tubes 21 of the upper and lower units. One unit rests on a ground and a person sits on the web of the upper unit.

As shown in FIG. 7, a modified design of pack frame **10*a* is generally the same as pack frame 10 except that instead of the above described rods 13, the device includes a plurality of interconnectable rods 13*a* on each side and a plurality of webs 22**, so as to selectively also form a litter or stretcher for carrying a wounded comrade hunter or big game out of a wilderness.

While various other changes may be made in the detail construction, it is understood that such changes will be within the spirit and scope of the present invention as is defined by the appended claims.

What we now claim is:

1. In a portable take-apart pack frame convertible between a backpack configuration and a seat configuration, the combination comprising:

a first unit of rigid rectangular structure;

a second unit of rigid rectangular structure;

said first and said second units being identically constructed as U-shaped members having a pair of parallel spaced-apart side members joined at one end by a cross element and at their opposite ends by a cross brace;

each of said side member ends adjacent to said cross brace terminating in an open socket having a central axis along the longitudinal axis of each of said respective side members;

each of said side members further having an open socket having a transverse axis normal to the longitudinal axis of said side member and perpendicular to said cross element and said cross brace, and a pair of linear elongated rods having opposite ends insertably and selectively receivable into said transverse sockets and said longitudinal sockets to define said seat configuration when said elongated rods are received in said respective transverse sockets and to define said backpack configuration when said elongated rods and received in said respective longitudinal sockets.

2. The invention as defined in claim 1 wherein:

said open sockets having a central axis along the side member longitudinal axis occupied by said rod ends to constitute said backpack configuration and said open socket having a transverse axis normal to said side member longitudinal axis occupied by said rod ends to constitute said seat configuration.

3. The invention as defined in claim 2 including:

stop means cooperatively carried on said rod ends and said side member sockets for limiting insertion of said rod ends into said respective sockets in either said seat or said backpack configuration.

4. The invention as defined in claim 3 wherein:

said first and second units of rigid rectangular structure are connected in parallel with respect to each other in said seat configuration and connected in end-to-end configuration in said backpack configuration.

* * * * *